US010889971B2

(12) United States Patent
Kinikarslan et al.

(10) Patent No.: US 10,889,971 B2
(45) Date of Patent: Jan. 12, 2021

(54) FLUSH MOUNTED BUILT-IN BODY FOR A SANITARY FITTING WITH AN AXIALLY ADJUSTABLE PUSH BUTTON

(71) Applicant: Grohe AG, Hemer (DE)

(72) Inventors: Turgut Kinikarslan, Witten (DE); Frank-Thomas Luig, Menden (DE); Daniel Berghoff, Dortmund (DE)

(73) Assignee: Grohe AG, Hemer (DE)

( * ) Notice: Subject to any disclaimer, the term of this patent is extended or adjusted under 35 U.S.C. 154(b) by 63 days.

(21) Appl. No.: 16/513,081

(22) Filed: Jul. 16, 2019

(65) Prior Publication Data

US 2020/0011035 A1 Jan. 9, 2020

Related U.S. Application Data

(63) Continuation of application No. PCT/EP2018/050970, filed on Jan. 6, 2018.

(30) Foreign Application Priority Data

Jan. 16, 2017 (DE) ..... 10 2017 100 711

(51) Int. Cl.
*E03C 1/04* (2006.01)

(52) U.S. Cl.
CPC ..... *E03C 1/0412* (2013.01)

(58) Field of Classification Search
USPC ..... 4/677
See application file for complete search history.

(56) References Cited

U.S. PATENT DOCUMENTS

2013/0036854 A1* 2/2013 Huang ..... F16K 31/605 74/543
2018/0313066 A1* 11/2018 Ye ..... E03C 1/0409
2019/0338500 A1* 11/2019 Berghoff ..... E03C 1/041

FOREIGN PATENT DOCUMENTS

| | | | |
|---|---|---|---|
| DE | 1 886 371 | U | 1/1964 |
| DE | 10 2015 002 786 | A1 | 9/2016 |
| DE | 10 2015 002 942 | A1 | 9/2016 |
| EP | 0 281 878 | A1 | 9/1988 |
| EP | 0 506 215 | A2 | 9/1992 |
| WO | WO 2008/053207 | A1 | 5/2008 |

* cited by examiner

*Primary Examiner* — Huyen D Le
(74) *Attorney, Agent, or Firm* — Muncy, Geissler, Olds & Lowe, P.C.

(57) ABSTRACT

A flush mounted built-in body for a sanitary fitting, having a mixer with a regulating nut, wherein the regulating nut can be rotated about a rotational axis, a support plate having a hub, a stop ring having a stop supported by the hub of the support plate, and a rotating knob for actuating the mixer. A rotational movement of the rotating knob is limited by the stop of the stop ring and the rotating knob comprises a hollow shaft which couples the rotating knob in a non-rotating manner to the regulating nut and can be adjusted parallel to the rotational axis of the regulating nut.

10 Claims, 2 Drawing Sheets

FLUSH MOUNTED BUILT-IN BODY FOR A SANITARY FITTING WITH AN AXIALLY ADJUSTABLE PUSH BUTTON

This nonprovisional application is a continuation of International Application No. PCT/EP2018/050970, which was filed on Jan. 16, 2018, and which claims priority to German Patent Application No. 10 2017 100 711.3, which was filed in Germany on Jan. 16, 2017, and which are both herein incorporated by reference.

BACKGROUND OF THE INVENTION

Field of the Invention

The present invention relates to a flush-mounted body for a sanitary fitting, which is fastened inside a wall opening, a cavity in a wall or another type of support. In particular, in built-in walls and pre-wall systems such flush-mounted body have proven to be successful.

Description of the Background Art

Flush-mounted bodies serve to fasten a functional unit in a stone wall, a wall or a support. The functional unit may comprise a mixer, such as a thermostat cartridge, and/or a valve. By means of the mixer, a cold water and a hot water are miscible to a mixed water with a desired mixed water temperature, wherein the volume of the mixed water to be removed is controllable by means of the valve. At least one mixed water pipe is connectable to the flush-mounted body, through which the mixed water of the sanitary fixture, such as a hand-held shower head, overhead shower head, nozzle, spout and/or the like on a shower and/or bathtub, can be supplied. The cold water connection is generally connected to a cold water house connection and the hot water connection is generally connected to a hot water house connection via corresponding pipes. At different installation depths of flush-mounted bodies in the stone wall, wall or the support, push buttons and rotary knobs for controlling the flush-mounted body can protrude at different distances from the wall. As a result, a uniform outer appearance of the push buttons and rotary knobs after the flush-mounted body is installed in the wall cannot be guaranteed. In addition, in an inaccurate installation of the flush-mounted bodies, stop forces or bending moments of the push buttons and/or rotary knobs can be transmitted to the mixer. As a result, gaps between the push buttons and rotary knobs or between the rotary knobs and a cover of the flush-mounted body can occur that affect the appearance.

SUMMARY OF THE INVENTION

It is therefore an object of the present invention to at least partially solve the problems described in reference to the prior art and in particular to provide a flush-mounted body for a sanitary fitting with which a uniform outer appearance can be ensured and with which stop forces or bending moments acting on a mixer by a push button or rotary knob are at least reduced.

In an exemplary embodiment, a flush-mounted body for a sanitary fitting is provided that includes a mixer with a regulating nut, wherein the regulating nut is rotatable about an axis of rotation, a support plate with a hub, a stop ring with a stop, wherein the stop ring is supported by the hub of the support plate, and a rotary knob for controlling the mixer, wherein a rotary movement of the rotary knob is limited by the stop of the stop ring and wherein the rotary knob has a hollow shaft by means of which the rotary knob is coupled to the regulating nut in a non-rotatable manner and is adjustable parallel to the axis of rotation of the regulating nut.

The flush-mounted body is used in particular for sanitary fittings that are applied in connection with showers and/or bathtubs. The sanitary fittings may in particular be water spouts, hand-held shower heads, overhead shower heads, nozzles and/or the like. Such flush-mounted bodies are generally mounted inside a wall breakthrough, a cavity in a wall or another type of support and serve to accommodate a functional unit.

The flush-mounted body has a mixer which is at least partially arranged in particular in a housing of the flush-mounted body and which may be formed, for example, in the manner of a manual mixer or a thermostat cartridge. The mixer can be part of the functional unit. In addition, the functional unit may in particular comprise at least one valve. By means of the mixer, in particular a cold water and a hot water are miscible to a mixed water with a desired mixed water temperature. In this case, the cold water can have a cold water temperature, which is in particular at most 25° C. (Celsius), preferably 1° C. to 25° C., particularly preferably 5° C. to 20° C. The hot water may have a hot water temperature, which is in particular at most 90° C., preferably 25° C. to 90° C., more preferably 55° C. to 65° C. The mixed water can be supplied from the mixer, for example, with at least one line in the functional unit to the at least one valve, by means of which a volume of the mixed water to be removed can be controlled via the sanitary fitting. The functional unit is in particular at least partially disposed in a receiving space of a housing of the flush-mounted body and/or is substantially cylindrical. To set the mixed water temperature of the mixed water, the mixer has a regulating nut which is rotatable about an axis of rotation.

Furthermore, the flush-mounted body has a support plate with a hub. The support plate is in particular circular and/or at least partially made of plastic. The hub is in particular at least partially tubular and/or extends parallel to the axis of rotation of the regulating nut of the mixer. The hub may be integrally formed with the support plate or fixed to the support plate by means of fasteners such as screws, clamps or brackets. The hub of the support plate carries a stop ring whose inner diameter corresponds in particular substantially to an outer diameter of the hub. As a result, the stop ring is attachable to the hub of the support plate substantially free of play. The stop ring has a stop which extends in particular from an outer circumferential surface of the stop ring in a radial direction to the outside. The stop may be designed in particular in the manner of a drag stop, which is mounted on the stop ring in a circumferential direction of the stop ring and is movable over a predetermined distance. By means of the stop, the rotational movement of the rotary knob for adjusting the mixed water temperature can be limited.

Thus, by means of the stop, a minimum and/or maximum mixed water temperature of the mixed water can be predetermined. In particular, the stop ring is not fastened to the mixer, but away from the mixer to the hub of the support plate. Furthermore, the stop ring is fixed by the rotary knob in an axial direction, that is, in particular parallel to the axis of rotation of the regulating nut.

The rotary knob has a hollow shaft by which the rotary knob is non-rotatably coupled to the regulating nut and is adjustable in parallel with the axis of rotation of the regulating nut. The hollow shaft is inserted in particular frontally into the rotary knob and is engaged with the rotary knob in such a way that the rotary knob and the regulating nut are non-rotatably connected to each other. A user can thereby adjust the mixed water temperature by rotating the rotary knob about the axis of rotation. To compensate for the installation depth of the flush-mounted body and to independently transfer the rotational movement of the rotary knob from the installation depth of the flush-mounted body, the rotary knob is adjustable on the regulating nut in parallel with the axis of rotation of the regulating nut. In addition to the possibility of offsetting different installation depths of the flush-mounted body, this embodiment has the further advantage that for adjusting the mixer, it is no longer necessary to disassemble the entire rotary knob. To adjust, only a knob cap and the hollow shaft have to be disassembled so that the regulating nut can be accessed from one end of the rotary knob, for example by means of a screwdriver or the like. The flush-mounted body ensures that the flush-mounted bodies always have the same visual appearance even at different installation depths. In addition, very flat cover rosettes and a shallow installation depth of the flush-mounted body (for example, of 75 mm (millimeters)) can be implemented. In addition, the rotary knob and the mixer are decoupled, so that except for the operating torque, no further stop forces or bending moments or the like are applied from the rotary knob to the mixer. In addition, installation errors, such as slight imbalances, no longer affect the appearance of the gap between a knob shaft and the cover rosette. Moreover, to adjust the mixer, it is no longer necessary to disassemble the entire rotary knob, but instead only the knob cap and the hollow shaft have to be disassembled.

The regulating nut can have a first groove toothing and the hollow shaft has a second groove toothing and wherein the hollow shaft engages via the first groove toothing with the second groove toothing of the regulating nut. The individual grooves of the first groove toothing and of the second groove toothing extend in particular in parallel with the axis of rotation of the regulating nut. The first groove toothing is, in particular, a first external groove toothing and/or the second groove toothing, in particular, is a second internal groove toothing.

Furthermore, it is advantageous if the hollow shaft is non-rotatably connected to the rotary knob. This means in particular that a rotation of the rotary knob can be transferred to the hollow shaft.

Moreover, it is advantageous if the hollow shaft has a third groove toothing via which the hollow shaft is connected to the rotary knob. The third groove toothing is in particular a third external groove toothing.

The hollow shaft can be positioned in parallel with the axis of rotation by means of a knob cap of the rotary knob. This means in particular that the knob cap holds the hollow shaft in parallel with the axis of rotation on the hub of the support plate. The knob cap is fastened in particular to the front side of the rotary knob.

The rotary knob can have a button which cooperates with a push of a button of the stop ring. In particular, the push of the button extends outward in a radial direction from an outer circumferential surface of the stop ring. The push of the button limits the adjustable mixed water temperature (in an intermediate position) to a specific value, for example 38° C. By pressing the button, the push of the button can be overridden by the rotary knob, so that a higher mixed water temperature can be adjusted until the rotation of the rotary knob is limited by the stop of the stop ring (in an end position).

The rotary knob can be fastened to the hub with a locking ring. The locking ring fixes the rotary knob, in particular in the axial direction, so that the rotary knob cannot come off the hub.

The hub can be fastened to the support plate by a screw connection or clamp connection. In particular, the hub is a separate component from the support plate.

The stop ring can be at least partially concealed by a scale ring. As a result, the stop ring is at least partially no longer visible from the outside after installing the flush-mounted body. The scale ring has in particular a scale for the mixed water temperature. In this way, a desired mixed water temperature can be set by means of the rotary knob.

Furthermore, it is advantageous if the stop ring is fixed in parallel with the axis of rotation by means of the rotary knob.

Further scope of applicability of the present invention will become apparent from the detailed description given hereinafter. However, it should be understood that the detailed description and specific examples, while indicating preferred embodiments of the invention, are given by way of illustration only, since various changes, combinations, and modifications within the spirit and scope of the invention will become apparent to those skilled in the art from this detailed description.

BRIEF DESCRIPTION OF THE DRAWINGS

The present invention will become more fully understood from the detailed description given hereinbelow and the accompanying drawings which are given by way of illustration only, and thus, are not limitive of the present invention, and wherein.

DETAILED DESCRIPTION

Figure 1:
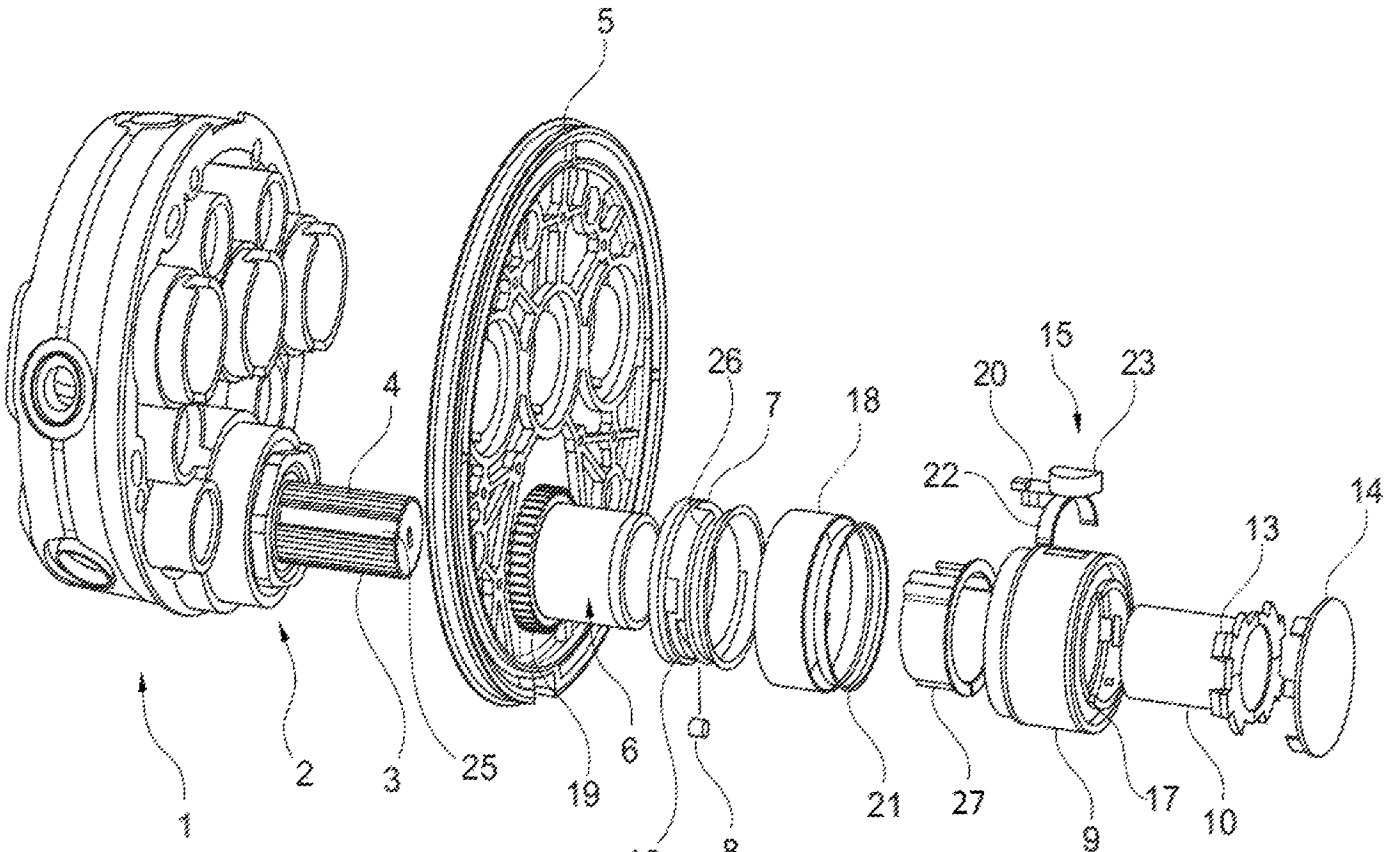
FIG. 1 is a flush-mounted body in an exploded view.

FIG. 1 shows a flush-mounted body 1 in an exploded view. The flush-mounted body 1 is substantially cylindrical in shape and has in its interior a mixer 2 designed as a thermostat cartridge with a regulating nut 3. The regulating nut 3 has a first groove toothing 4 on a first outer circumferential surface 25. A support plate 5 with a hub 6 can be fastened on the flush-mounted body 1. The hub 6 is surrounded by a receptacle 19 for a stop ring 7, so that the stop ring 7 is non-rotatably carried by the hub 6. On the stop ring 7, a stop 8 formed in the manner of a drag stop and a stationary push of a button 16 is disposed at a second external circumferential surface 26. The stop ring 7 is at least partially concealed by means of a scale ring 18, so that the stop ring 7 is no longer visible after the rotary knob 9 is installed. The scale ring 18 includes a slide ring 21. The flush-mounted body 1 further comprises a rotary knob 9 fastened to the hub 6 of the support plate by means of a locking ring 17.

The rotary knob 9 has a button 15, which includes a button cap 23 and a button base 20. The button base 20 together with the touch of the button 16 of the stop ring 7 serves to limit a rotation of the rotary knob 9. By pressing the button 15, the push of the button 16 of the stop ring 7 is overridden, so that the rotary knob 9 is rotatable beyond the push of the button 16. The button 15 is held by means of leaf springs 22 on contact surfaces of a slotted slide ring 27 of the rotary knob 9. The slotted slide ring 27 also cooperates with the stop 8 of the stop ring 7 so that the rotation angle of the rotary knob 9 is limited in both directions of rotation. Furthermore, the rotary knob 9 has a hollow shaft 10 with a third groove toothing 13 so that the hollow shaft 10 can be inserted in the rotary knob 9 and can be arranged inside the rotary knob 9, non-rotatable to the rotary knob 9. The hollow shaft 10 is covered by a knob cap 14.

Figure 2:
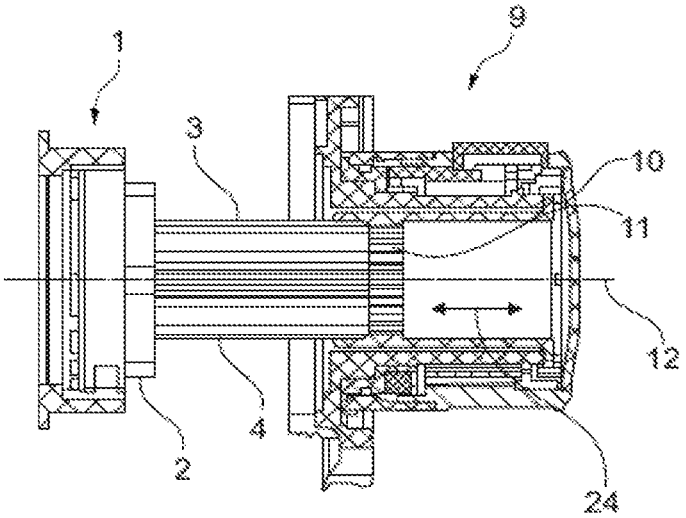
FIG. 2 shows the flush-mounted body in a deep installation position in the region of a rotary knob.

FIG. 2 shows the flush-mounted body 1 in a deep installation position in the area of the rotary knob 9. The hollow shaft 10 has a second groove toothing 11, with which the hollow shaft can be plugged on the first groove toothing 4 of the regulating nut 3 in an axial direction 24 in parallel with a rotation axis 12 of the regulating nut 3 of the mixer 2.

Figure 3:
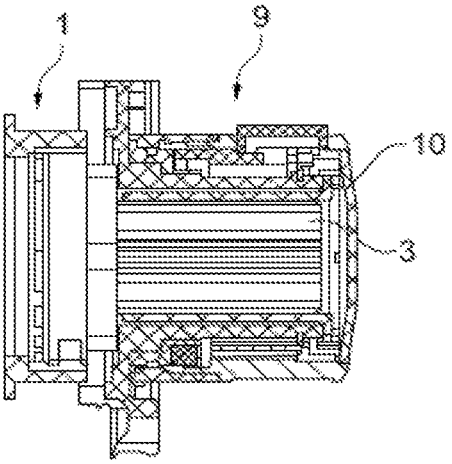
FIG. 3 shows the flush-mounted body in a shallow installation position in the region of the rotary knob.

FIG. 3 shows the flush-mounted body 1 in a shallow installation position in the region of the rotary knob 9. In the illustrated shallow installation position of the flush-mounted body 1, the rotary knob 9 with the hollow shaft 10 is pushed completely onto the regulating nut 3.

With the proposed sanitary fitting, a uniform external appearance can be ensured and stop forces or bending moments acting from the rotary knob on the mixer are at least reduced.

The invention being thus described, it will be obvious that the same may be varied in many ways. Such variations are not to be regarded as a departure from the spirit and scope of the invention, and all such modifications as would be obvious to one skilled in the art are to be included within the scope of the following claims

What is claimed is:

1. A flush-mounted body for a sanitary fitting, comprising:

a mixer with a regulating nut that is rotatable about an axis of rotation;

a support plate with a hub;

a stop ring with a stop, the stop ring being carried by the hub of the support plate; and a rotary knob to control the mixer, wherein a rotational movement of the rotary knob is limited by the stop of the stop ring, and wherein the rotary knob has a hollow shaft via which the rotary knob is non-rotatably coupled to the regulating nut and is adjustable in parallel with the axis of rotation of the regulating nut.

2. The flush-mounted body according to claim 1, wherein the regulating nut has a first groove toothing and the hollow shaft has a second groove toothing, and wherein the hollow shaft is in engagement with the second groove toothing of the regulating nut via the first groove toothing.

3. The flush-mounted body according to claim 1, wherein the hollow shaft is non-rotatably connected to the rotary knob.

4. The flush-mounted body according to claim 3, wherein the hollow shaft has a third groove toothing via which the hollow shaft is connected to the rotary knob.

5. The flush-mounted body according to claim 1, wherein the hollow shaft is positioned in parallel with the axis of rotation via a knob cap of the rotary knob.

6. The flush-mounted body according to claim 1, wherein the rotary knob has a button that cooperates with a push of a button of the stop ring.

7. The flush-mounted body according to claim 1, wherein the rotary knob is fastened by a locking ring on the hub.

8. The flush-mounted body according to claim 1, wherein the hub is fastened to the support plate via a screw connection or clamp connection.

9. The flush-mounted body according to claim 1, wherein the stop ring is at least partially concealed by a scale ring.

10. The flush-mounted body according to claim 1, wherein the stop ring is fixed in parallel with the axis of rotation via the rotary knob.

* * * * *